United States Patent [19]

Graffy

[11] Patent Number: 4,716,988

[45] Date of Patent: Jan. 5, 1988

[54] LADDER STEP CONSTRUCTION FOR USE WITH RECREATIONAL VEHICLES AND BOATS

[75] Inventor: Thomas F. Graffy, Los Angeles, Calif.

[73] Assignee: Top Line Manufacturing Inc., Paramount, Calif.

[21] Appl. No.: 893,737

[22] Filed: Aug. 6, 1986

[51] Int. Cl.[4] ..... E06C 7/08

[52] U.S. Cl. ..... 182/228; 182/46; 182/194

[58] Field of Search ..... 182/46, 228, 206, 194; 403/378

[56] References Cited

U.S. PATENT DOCUMENTS

| | | | |
|---|---|---|---|
| 3,549,182 | 12/1970 | Bogue | 403/378 |
| 3,944,024 | 3/1976 | Adas | 182/228 |
| 4,151,895 | 5/1979 | Rasada | 182/228 |
| 4,193,477 | 3/1980 | Broyles | 182/228 |
| 4,496,029 | 1/1985 | Kuroda | 182/46 |
| 4,536,037 | 8/1985 | Rink | 403/378 |

*Primary Examiner*—Reinaldo P. Machado
*Attorney, Agent, or Firm*—Monty Koslover

[57] ABSTRACT

A new construction method for a ladder for use on recreational vehicles and boats is disclosed. The ladder comprises two parallel metal tubular rails and a plurality of extruded aluminum steps, including step end caps. The steps are a unique triple-void hollow extrusion, fastened to the ladder rails with a spring pin that goes through two walls of the step extrusion and both walls of the rail tubing, anchoring in a third wall of the step extrusion. This provides a solid, close-coupled assembly that avoids the stresses caused by traditional cantilevered screw fastening methods. Plastic end caps molded with interference fingers, permitting assembly without mechanical fasteners, fit in the ends of the steps, providing protection and an attractive finish to the steps.

1 Claim, 7 Drawing Figures

LADDER STEP CONSTRUCTION FOR USE WITH RECREATIONAL VEHICLES AND BOATS

BACKGROUND OF THE INVENTION

1. Field of the Invention

This invention relates to ladders used primarily for recreational vehicles, and particularly to the ladder step construction and its method of fastening to the ladder rails.

2. Description of the Prior Art

In the traditional method of ladder assembly, the steps are fastened by long cantilevered screws that go through the end cap, an air space and then through both walls of the rail tubing. This places great shear stress on the long unsupported screws. Such an arrangement is typically used in U.S. Pat. No. 4,193,477 by Broyles and others. There are also numerous methods of fastening the ladder steps to the rails such as utilizing forced fit and metal flow, or by fitting the ends of each step to the rails and swaging or welding them. In a few cases, end caps are used to protect the inner surfaces of the steps from corrosion. In the Broyles invention, the end caps are screwed into the step and form part of the fastening mechanism.

In order to produce the necessary stiffness and strength required to support heavy loads, the step constructions used in the past are relatively heavy, or of intricate cross-section and manufacture, often presenting problems in fabrication and durability. Thus, there exists a need for a ladder step construction which is at once light, strong, simple in fabrication and durable in use.

SUMMARY OF THE INVENTION

The invention comprises two parallel spaced vertical metal rails and a plurality of spaced metal steps, which are mounted to the rails by passing a rail through a hole in each end of the step. Each step is equipped with an integral non-slip surface, and is a unique triple-void hollow extrusion of a metal such as aluminum, making it extremely stiff and strong. Enclosure of the step is provided by two plastic end caps, one in each end of the step, which fit tightly to the step without mechanical fasteners or adhesive. The step is fastened to the ladder rails with a spring pin that goes through two walls of the step extrusion, both walls of the rail tubing, and anchors in a third wall of the extrusion. This provides a solid, close-coupled assembly that avoids the risk of the traditional method of ladder assembly utilizing long cantilevered screws.

Accordingly, it is a principal object of this invention to provide a ladder structure which is inherently stiff, strong and safe, and which is suitable for use with recreational vehicles and boats.

Another object is to provide a step structure which is light in weight, simple in fabrication and durable in use.

It is another object to provide a means of fastening the steps to the rails that will avoid the stresses caused by cantilever fastening methods. It is yet another object to provide a step construction whose ends are protected from the environment, by end caps.

Further objects and advantages of the invention will become apparent from the study of the following portion of the specification, the claims and the attached drawings.

DESCRIPTION OF THE PREFERRED EMBODIMENTS

Figure 1:
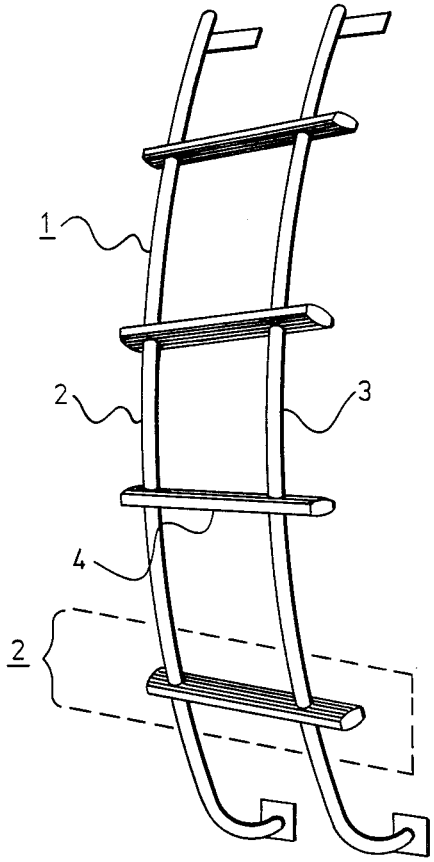
FIG. 1 is a perspective view of a typical ladder for recreational vehicles and boats, showing the steps of the present invention.

Referring particularly to the drawings, there is shown in FIG. 1 a typical ladder 1 for recreational vehicles and boats, embodying the ladder steps of the present invention. The ladder 1 comprises a left hand rail 2, a right hand rail 3 and a plurality of ladder steps 4. The shape of the rails may vary, depending on the application, and the number of ladder steps may also vary depending on the length of the ladder. Both the left hand rail 2 and the right hand rail 3 may be fabricated from aluminum alloy tubing, stainless steel tubing or any suitable metal having the desired properties of strength and light weight. Holes are cut through each rail on the center line and spaced so as to match the spacing of each of the ladder steps 4. The holes are sized to accommodate a spring pin 6 (not shown) with which each ladder step is fastened to the rails 2 and 3.

Figure 2:
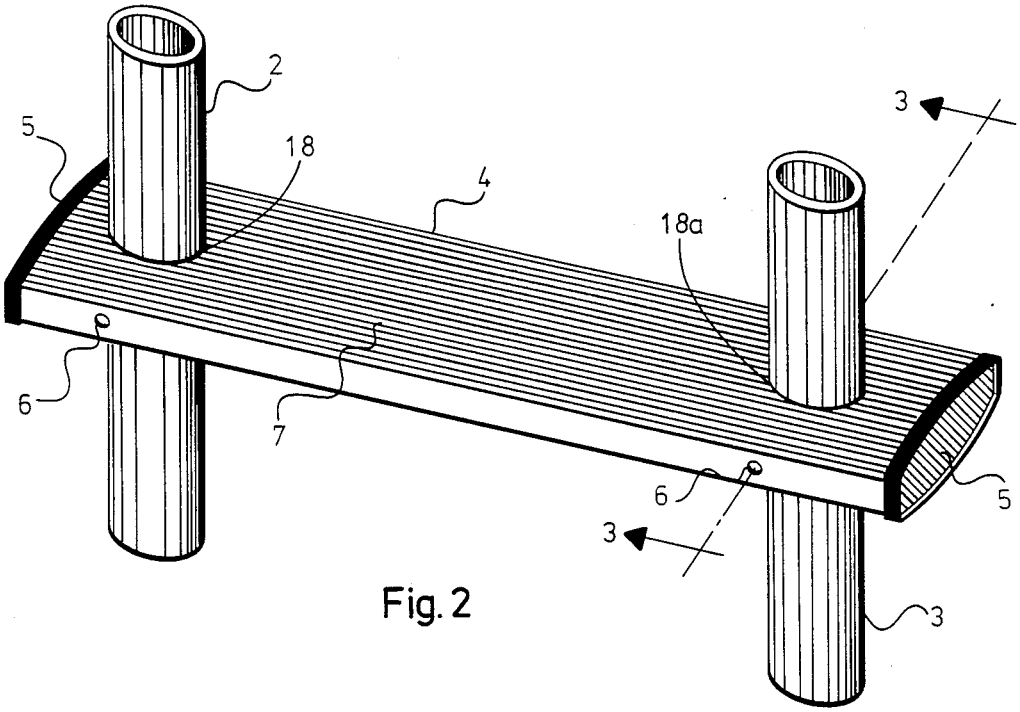
FIG. 2 is an enlarged perspective view of part of the ladder, showing the portion indicated by the numeral 2 in FIG. 1.

Referring now to FIG. 2, a perspective view is shown of part of the ladder 1, showing a typically mounted ladder step 4 in perspective view. The surface top and bottom of ladder step 4 is longitudinally grooved with a multiplicity of serrations 7 providing an aggressive non-slip surface for maximum safety. The serrations 7 are approximately 0.010 in. deep by 90 deg., and cut into the surface of ladder step 4, forming an integral part of the step. Attached to each ladder step 4 are two plastic end caps 5, one for each end, providing a protective enclosure for the ladder step 4. The step 4 is attached to each rail by a spring pin 6. A first hole 18 and a second hole 18*a*, are cut in ladder step 4 to allow for rails 2 and 3 to pass through snugly.

Figure 3:
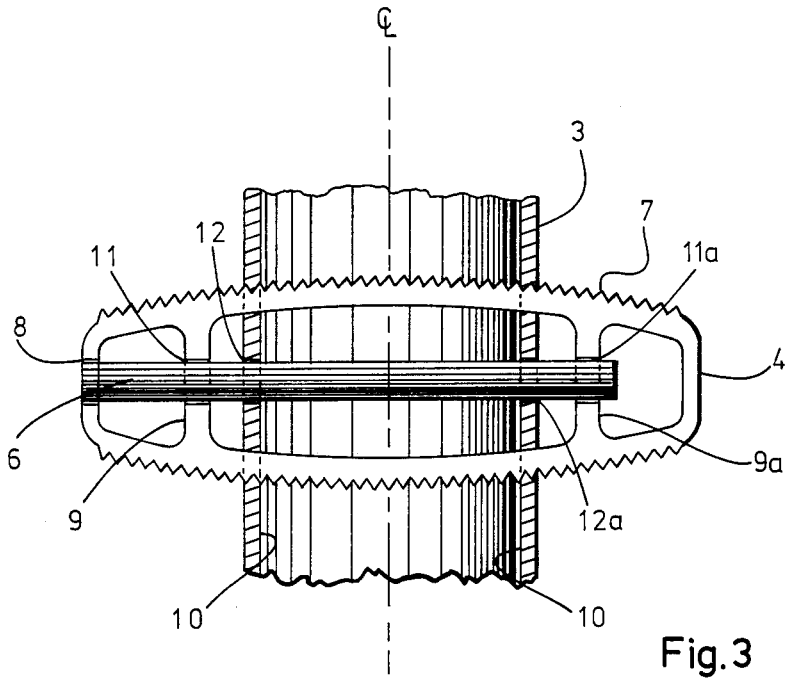
FIG. 3 is a cross-section view of the step taken along line 3—3 of FIG. 2.
Figure 4:
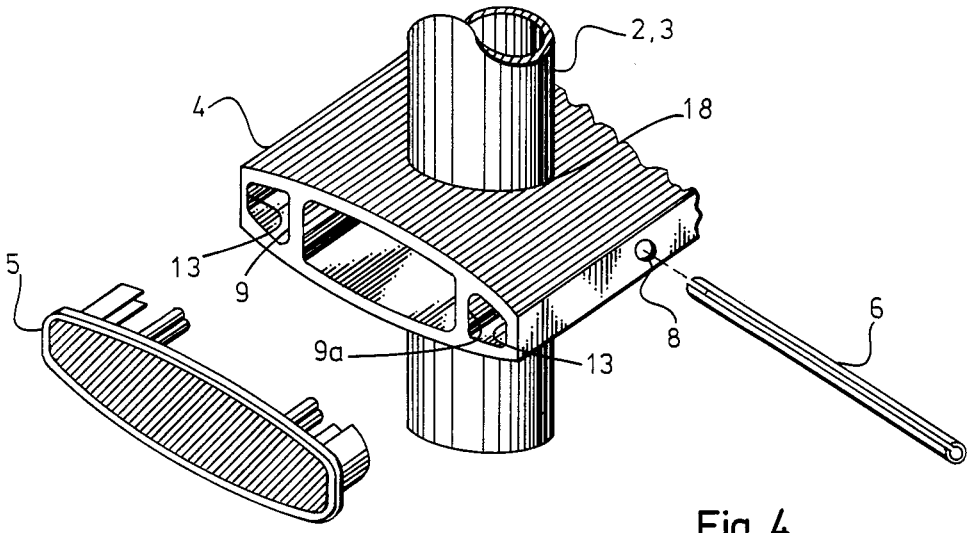
FIG. 4 is a partial end view of the step, illustrating the step, end cap and spring pin in exploded view.

Referring specifically to FIGS. 3 and 4, there are shown a cross-section view of the assembled step 4 taken along line 3—3 of FIG. 2, and a partial end view of step 4 showing part of the assembly in exploded view. The material of ladder step 4 is preferably an aluminum alloy, extruded in the cross-section shape shown in FIG. 3, to be a longitudinal triple-void hollow extrusion. The wall thickness of step 4, including the inner walls 9, is typically 0.060 in. approximately. As shown in FIG. 3, the two inner extrusion walls 9, 9*a* are located at a distance approximately one fifth of the ladder step 4 width from each side. Spring pin 6 is made of a hardened steel such as stainless spring steel or zinc plated hardened steel, and end cap 5 is formed of a molded plastic material. As depicted in FIG. 3, when spring pin 6 is inserted for fastening, it is inserted through one side of step 4 only at pin hole 8, passing through a second hole 11 in second extrusion wall 9, through a first hole 12 and second hole 12*a* in the walls 10 of rail 3, and anchored in third extrusion wall 9*a* through third hole 11*a*. The spring pin 6 is thus evenly held in three places across most of the width of the ladder step 4, and through rail 3. There is then no cantilever stress action on the spring pin 6, which experiences only a relatively low distributed shear stress when a weight is placed on the step. As shown in FIG. 3, the spring pin 6 goes through only one side of the ladder step 4, and when assembled from the back of the ladder, the spring pin fastening is not visible from the front. The use of end caps 5, which are pushed into the ends of ladder step 4, shown in FIG. 4, provides protection to the ladder construction from the environment, and an attractive finishing detail for the step. Safety considerations are also served by the end cap 5, by preventing accidental contact with the edges of the aluminum alloy ladder step 4.

Figure 5A:
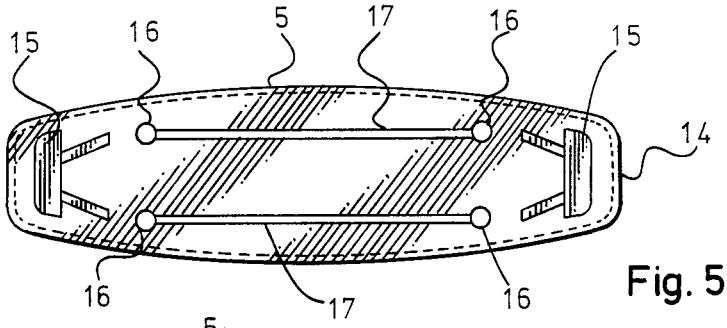
FIGS. 5*a* and 5*b* are respectively, the plan view and side elevation view of the end cap.
Figure 5B:
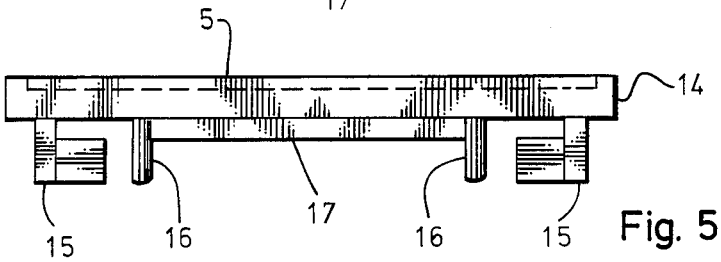
Figure 6:
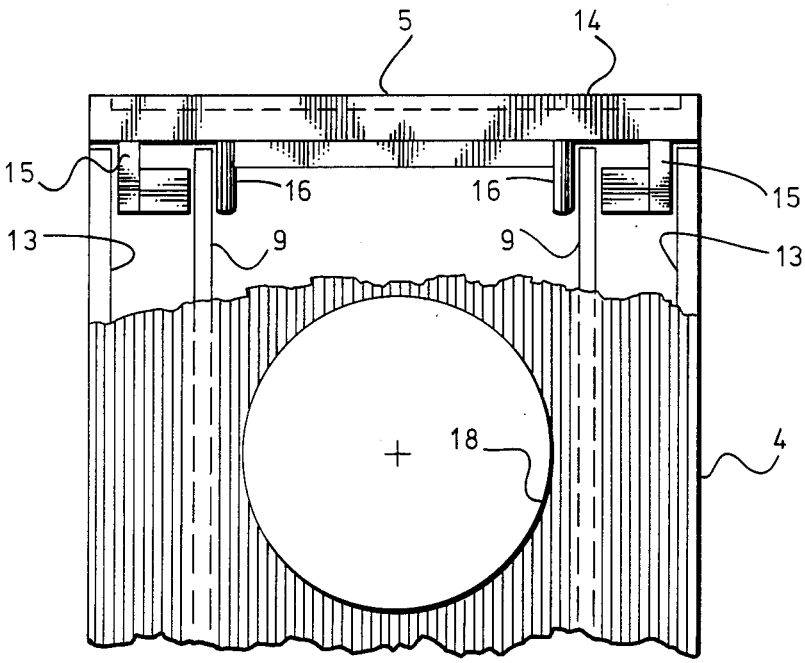
FIG. 6 is a top view of one end of the step, showing in a partial cutaway section, the engagement of the end cap with the step.

Referring now to FIGS. 5*a* and 5*b*, there are shown respectively a plan view and a side elevation view of end cap 5. The end cap 5 is molded from a plastic material, and sized and shaped to fit in closely in the ends of ladder step 4, so that it is held tightly without need for adhesive. Two different types of cap projections are used to achieve the interference fit of the end cap 5 with the end cavity of ladder step 4. These projections are interference fingers 15 and posts 16. The preferred shapes of interference fingers 15 and posts 16 are depicted in FIGS. 5*a* and 5*b*. Interference finger 15 is comprised of three parts joined together: a relatively stiff pillar or 'shoe', and two flat flexible flaps which are angled outward. The two flaps and the pillar are designed to exert pressure against the inner walls of the ladder step 4 end cavity. Post 16 is a cylindrical column. These posts 16 are joined in pairs at their bases by a stiffener 17. A cap base 14 provides the base upon which interference fingers 15, posts 16 and stiffeners 17 are attached, and also a finished, decorative external surface. As an aid in understanding of its use, the end cap 5 is illustrated in FIG. 6 in a cutaway view, as it would be if inserted in the end cavity of ladder step 4. Posts 16 aid in alignment of end cap 5 onto the step extrusion. Retention of end cap 5 in the step is effected by the engagement of interference fingers 15 in the end pockets or voids of the extrusion. As illustrated in FIG. 6, the rounded pillars or 'shoes' of interference fingers 15 fit firmly against the inside surface of wall 13, while the flexible flaps of 15 interfere with extrusion wall 9. The flexible flaps of 15 splay outward, exerting pressure on wall 9, forcing the pillar or "shoe" of 15 against wall 13. Since the flaps of interference finger 15 are flexible, they compensate for tolerances in the extrusion as well as the differential expansion through the wide range of temperature experienced by a recreational vehicle, continuing to have both flaps and pillar firmly engaged against walls 9 and 13.

Furthermore, when the spring pins 6 are assembled into the ladder steps 4 from the back of the ladder structure 1, and the end caps 5 are inserted in each end, the ladder is extremely clean in appearance, with no fasteners visible from the front or sides.

From the above description, it is apparent that the preferred embodiment achieves the objects of the present invention. Alternative embodiments and various modifications of the embodiments depicted will be apparent to those skilled in the art. These and other alternatives are considered to be equivalent and within the spirit and scope of the present invention.

Having described the invention, what is claimed is:

1. An end cap wherein: said end cap is molded from a plastic material, said end cap shape comprising a cap base, two interference fingers, four posts and two stiffeners; said interference finger being comprised of a relatively stiff pillar to which are joined two flat flexible flaps which are angled outward in order to apply pressure against the inner wall of a ladder step end cavity extrusion, forcing the stiff pillar against the outer wall surface of said step; said posts being cylindrical columns, arranged so as to aid in the alignment of said end cap in said ladder step end cavity extrusion; said stiffeners being employed to join said posts at their bases, providing support and stiffening to said end cap; said cap base providing the means for attaching and supporting said interference fingers remaining in interference contact with said ladder step end cavity extrusion throughout a wide range of temperature experienced.

* * * * *